US009089727B1

(12) United States Patent
Flood

(10) Patent No.: US 9,089,727 B1
(45) Date of Patent: Jul. 28, 2015

(54) FIRE SUPPRESSION SYSTEM FOR AIR DUCTS

(71) Applicant: Gerald Grattan Flood, Birmingham, MI (US)

(72) Inventor: Gerald Grattan Flood, Birmingham, MI (US)

( * ) Notice: Subject to any disclaimer, the term of this patent is extended or adjusted under 35 U.S.C. 154(b) by 0 days.

(21) Appl. No.: 14/158,377

(22) Filed: Jan. 17, 2014

(51) Int. Cl.
*A62C 37/11* (2006.01)
*A62C 2/06* (2006.01)

(52) U.S. Cl.
CPC ..... *A62C 3/14* (2013.01)

(58) Field of Classification Search
CPC ..... A62C 3/0221; A62C 3/04; A62C 4/02; A62C 4/04; A62C 35/10; A62C 37/11–37/12; A62C 37/14; A62C 37/16; A62C 3/14
USPC ..... 169/35, 42–43, 45–49, 54, 56, 57, 58, 169/65; 52/232, 220.8
See application file for complete search history.

(56) References Cited

U.S. PATENT DOCUMENTS

| | | | | | |
|---|---|---|---|---|---|
| 1,699,244 | A | * | 1/1929 | Lewis | 169/57 |
| 3,268,009 | A | * | 8/1966 | Bussey et al. | 169/16 |
| 3,720,153 | A | | 3/1973 | Jardinier et al. | |
| 3,763,936 | A | * | 10/1973 | Menage | 169/45 |
| 4,143,670 | A | | 3/1979 | Olson et al. | |
| 4,997,046 | A | * | 3/1991 | Evans, III | 169/54 |
| 5,163,516 | A | * | 11/1992 | Palmatier | 169/54 |
| 5,279,632 | A | | 1/1994 | Decker et al. | |
| 5,493,820 | A | | 2/1996 | Joseph | |
| 5,503,231 | A | * | 4/1996 | Palmatier | 169/54 |
| 5,575,312 | A | * | 11/1996 | Schroeder | 138/149 |
| 6,095,252 | A | | 8/2000 | Draugelates | |
| 6,105,678 | A | | 8/2000 | Tsai | |
| 2014/0138106 | A1 | | 5/2014 | Dolton | |

* cited by examiner

*Primary Examiner* — Melanie Tyson
*Assistant Examiner* — Chee-Chong Lee
(74) *Attorney, Agent, or Firm* — Wayne State University Law School Patent Procurement Law Clinic; Thomas D. Helmholdt

(57) ABSTRACT

A system for suppressing fires generated within air ducts. The system can include a duct with an aperture, a reservoir containing fire retardant material adjacent to the aperture, and a temperature-sensitive sidewall. The aperture can be sealed with the temperature-sensitive sidewall creating a temporary barrier to fluid communication with the interior of the duct and the reservoir. When a source of heat exists within the duct, the temperature-sensitive sidewall melts or ruptures, expelling fire retardant material. The temperature-sensitive sidewall can be a fusible plug or a frangible tube positioned within the duct in a non-obstructive fashion. The fire retardant material stored in the attached reservoir can be expelled into the interior of the duct, suppressing or retarding the source of heat in response to a temperature in excess to a predetermined value.

9 Claims, 4 Drawing Sheets

FIRE SUPPRESSION SYSTEM FOR AIR DUCTS

FIELD OF THE INVENTION

The invention relates to a fire suppression system with a method to prevent or extinguish fires in ducts, and more particularly, a fire suppression system having a temperature-sensitive material attached to the interior of a duct and to a reservoir containing fire suppressant material.

BACKGROUND

Several systems have attempted to deal with the issue of fires in air ducts. U.S. Pat. No. 6,105,678 discloses a heat responsive fire extinguishing assembly for a ventilating duct. The system includes a nozzle head that is mounted inside the duct. The nozzle head is in fluid communication with a reservoir containing the fire suppressant material via the valve. When the temperature inside the duct reaches a certain level, the valve is opened and the fire extinguishing material is dispensed through the nozzle in the duct. This automatic fire suppression system provides a nozzle head protruding into the duct undesirably blocking airflow through the duct.

U.S. Pat. No. 6,095,252 is a means for fighting fire in at least one cable or line run. A frangible tube is mounted inside a cable run. The tube is filled with fire extinguishing material under pressure. When the temperature inside the duct reaches a predetermined value, the tube ruptures releasing the fire extinguishing material into the cable. This reference depicts an automatic fire suppression system with a frangible tube adapted for suppressing fires in electrical cable runs.

U.S. Pat. No. 5,575,312 is a fire retarding heating and cooling duct. Heat meltable plastic is inserted into the duct at six foot intervals. When a fire occurs in the duct, the plastic melts almost immediately, sealing off the fire from the rest of the duct system. This type of duct stops the duct fire spreading to the rest of the ducting system.

U.S. Pat. No. 5,493,820 describes a fire preventing duct system. In this system a narrow tube containing cold water is inserted into the duct system. When a fire occurs, the heat is absorbed by the cold water, which impedes the progress of the fire. Once the temperature inside the duct reaches a predetermined value, the now hot water is flushed and replaced with cold water to absorb more heat, further impeding the progress of the fire. This system discloses a cooling system that removes heat from a duct system to delay the spread and growth of a potential duct fire.

U.S. Pat. No. 4,143,670 describes another system to impede the progress of a fire. The ducting fire protection system is created by placing a thermoplastic sleeve inside a duct. When a fire occurs, elevated temperatures inside the duct causes the sleeve to collapse, sealing off the fire from the rest of the duct system. This provides a device that seals off the duct fire from the rest of the ducting system.

U.S. Pat. No. 3,720,153 is another ducting fire protection system similar to the previous patent. In this system, a valve device is placed inside the duct. When a fire occurs, the elevated temperatures cause the value to close, stopping the fire from spreading to the rest of the duct system.

SUMMARY

A fire suppression system for air ducts furnishes a system to suppress fires that are generated within various types of ducts. The system can include an elongated duct with a small aperture through a sidewall with a reservoir containing fire retardant material mounted adjacent thereto. Fluid communication between the reservoir and the interior of the duct is accomplished by sealing the aperture with a temperature-sensitive material.

The system can use a fusible plug as the temperature-sensitive material. A fusible plug effectively seals the aperture on the duct sidewall. When the temperature increases or a fire starts inside a duct, the temperature-sensitive fusible plug dissolves, and the fire retardant material stored in the reservoir can be delivered into the interior of the duct.

The system can include using a frangible tube as the temperature-sensitive material attached to the interior of the duct along a peripherally extending or longitudinally extending groove. The tube is insertable through the aperture in the sidewall of the duct in order to recess the tube substantially within the groove in order to eliminate any obstruction to air flow through the duct. The frangible tube passing through the aperture effectively seals the air duct. The frangible tube is connected to the fire retardant containing reservoir located externally of the air duct in a position generally adjacent to the aperture. When the temperature increases or a fire starts inside a duct, the temperature-sensitive frangible tube dissolves, and the fire retardant material stored in the reservoir can be delivered into the interior of the duct.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
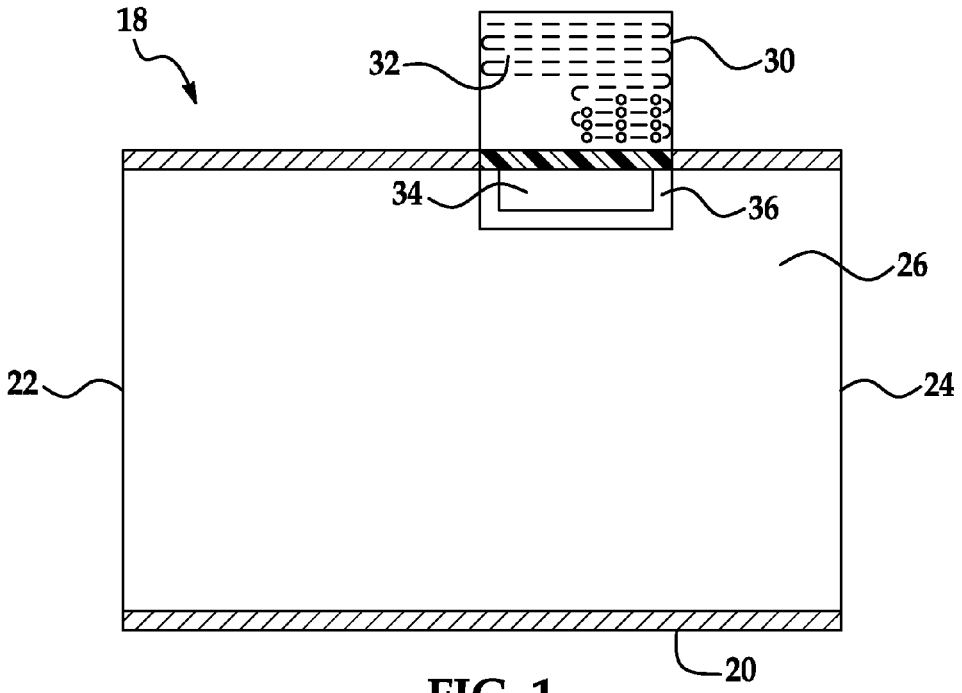
FIG. 1 is a simplified cross-sectional view of the fire suppression system depicting a longitudinally extending cross section through a duct and a reservoir for holding fire retardant material where a temperature-sensitive sidewall separates the reservoir from the duct in the form of a fusible plug.

Referring now to FIG. 1, a simplified cross-sectional view illustrates a fire suppression system 18 for a duct 20, such as by way of example and not limitation a Heating/Ventilation/Air-Conditioning (HVAC) duct. It should be recognized by those skilled in the art, that the duct can also be designed to capture and control hazardous emissions generated from product handling or processes, and convey those emissions to the outdoors. Hazardous emissions can include, by way of example and not limitation, flammable vapors, gases, fumes, mists, or dusts, and volatile or airborne materials posing a health hazard, such as toxic or corrosive materials, and ducts that can become fire hazards over time, such as residential and commercial laundry dryer vents where flammable lint can buildup over time. The duct 20 includes at least one aperture 36 allowing entry of a volume of fire retardant material into an interior space defined by the duct. A reservoir 30 is mounted in proximity to the aperture, either supported by the duct or supported separately therefrom. By way of example and not limitation, the reservoir 30 can be supported directly by the duct 20 overlying the aperture 36 formed through the sidewall of the duct 20. The reservoir 30 can provide a supply of fire retardant material 32 adjacent to the aperture 36. A temperature-sensitive sidewall 34 can be associated in fluid communication with the reservoir 30 and can extend through the aperture 36 to establish a temporary frangible barrier to direct fluid communication between the reservoir 30 and the interior volume 28 of the duct 20 in response to exposure to a temperature in excess of a predetermined value.

Figure 2:
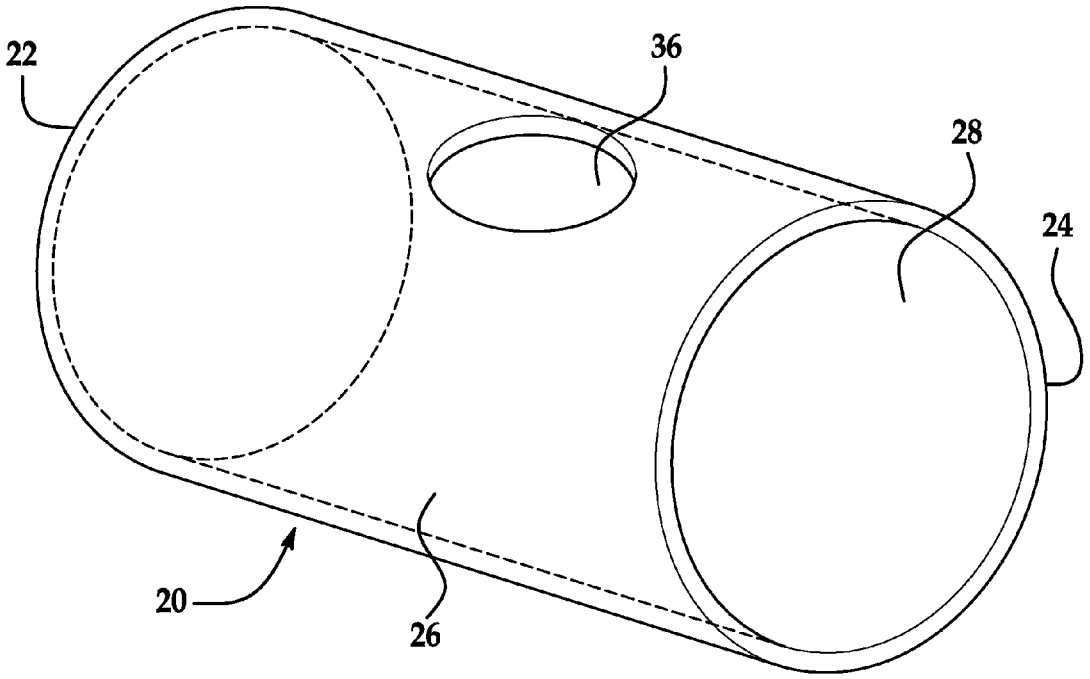
FIG. 2 is a simplified perspective view of the fire suppression system depicting a duct having an aperture formed therein for receiving a fusible plug including a temperature-sensitive sidewall positionable within the aperture.

Referring now to FIG. 2, the duct 20 can have a first end 22 and a second end 24 joined together by at least one sidewall 26 extending between the first and second ends creating an interior volume 28. The first end 22 and second end 24 can be joined together by more than one sidewall 26, if desired.

The sidewall 26 of the duct 20 can have at least one aperture 36 formed therein adjacent to the reservoir 30. The aperture 36 can be temporarily sealed using a frangible barrier having a temperature-sensitive portion defining a temperature-sensitive sidewall 34. The temperature-sensitive sidewall 34 can seal the aperture 36 in a non-obstructive fashion to eliminate any obstacle to air flowing through the duct 20. In order to ensure that the temperature-sensitive sidewall 34 is non-obstructive, the temperature-sensitive sidewall can be positioned flush with respect to an interior surface of the sidewall 26 of the duct 20.

Figure 3:
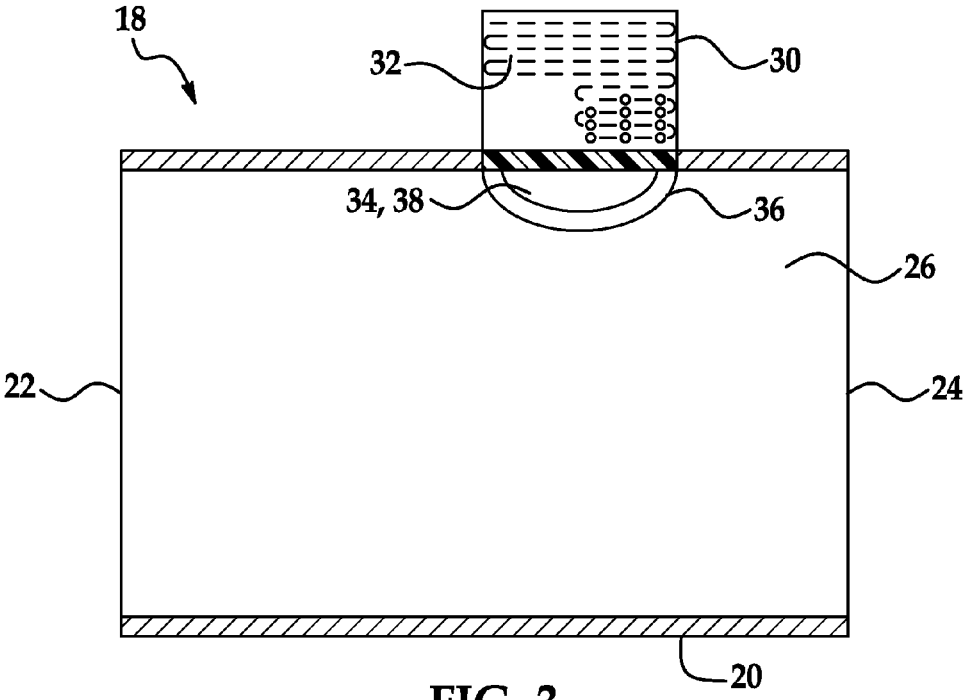
FIG. 3 is a simplified cross-sectional view of the fire suppression system depicting a longitudinally extending cross section through a duct and a reservoir for holding a fire retardant material where a temperature-sensitive sidewall separates the reservoir from the duct in the form of a fusible plug.

Referring now to FIG. 3, a cross-section view shows a fire suppression system 18 with a duct 20, reservoir 30 and a temperature-sensitive sidewall 34. The temperature sensitive sidewall 34 can be a fusible plug 38 inserted through the aperture 36 formed in the duct 20 effectively sealing the aperture 36. The temperature-sensitive sidewall 34 can define at least part of the fusible plug 38. Breaching the frangible barrier of the fusible plug 38 can allow the fire retardant material 32 stored in the reservoir 30 to be released into the interior volume 28 of the duct 20.

The fusible plug 38 can include a portion defining a temperature-sensitive sidewall 34 facing the interior volume 28 of the duct 20. The fusible plug 38 can be positioned through the aperture 36 in a substantially flush position in order to prevent any obstruction to the air flow through the duct 20. The fusible plug 38 can be in fluid communication with the reservoir 30 containing the fire retardant material 32. Fluid communication can be established between the interior volume 28 of the duct 20 and the reservoir 30 when the frangible barrier of the temperature-sensitive sidewall 34 is breached in response to exposure of the temperature-sensitive sidewall 34 to a temperature above a predetermined value.

The fusible plug 38 can melt when a predetermined temperature is achieved in the interior volume 28 of the duct 20. The melting of the fusible plug 38 ruptures the temporary frangible barrier and allows the fire retardant material 32 contained in the reservoir 30 to be released into the interior volume 28 of the duct 20. The introduction of the fire retardant material 32 can extinguish, retard, or suppress the source of heat within the interior volume 28 of the duct 20. The fusible plug 38 can be any material intended to melt when a predetermined temperature is detected within the interior volume 28 of the duct 20.

Figure 4:
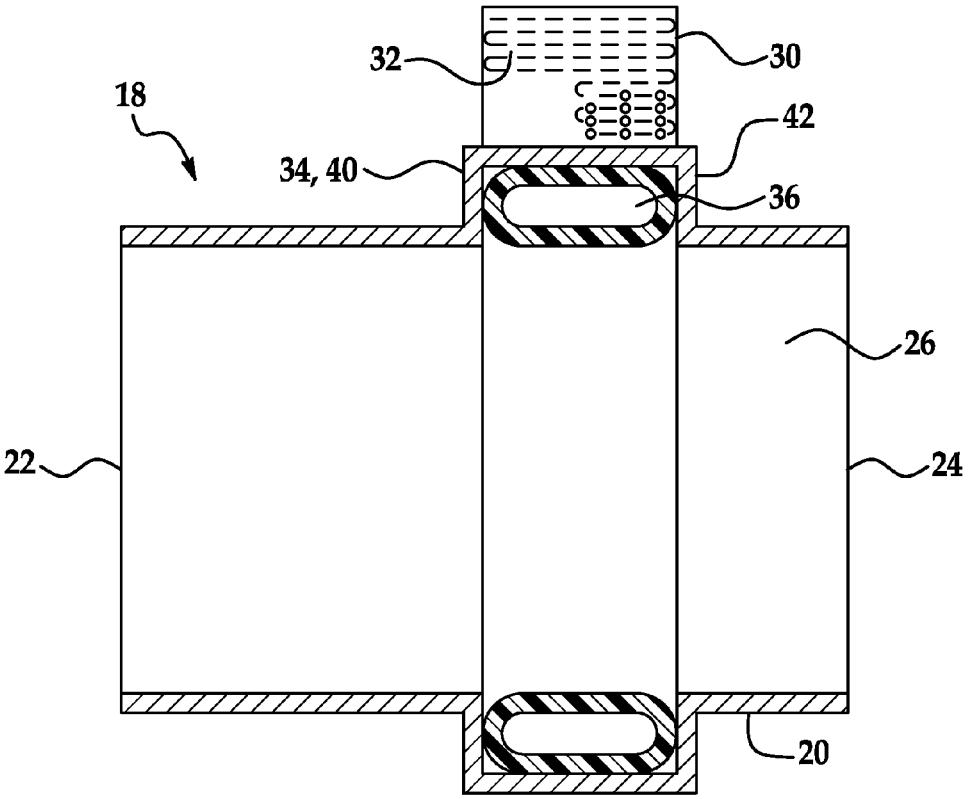
FIG. 4 is a simplified cross-sectional view of the fire suppression system depicting a longitudinally extending cross section through a duct with an aperture formed therein and a peripheral groove extending radially outwardly from an internal surface of the duct, and a reservoir for holding a fire retardant material where a temperature-sensitive sidewall separates the reservoir from the duct in the form of a frangible tube positioned within the groove and connected in fluid communication with the reservoir.
Figure 7:
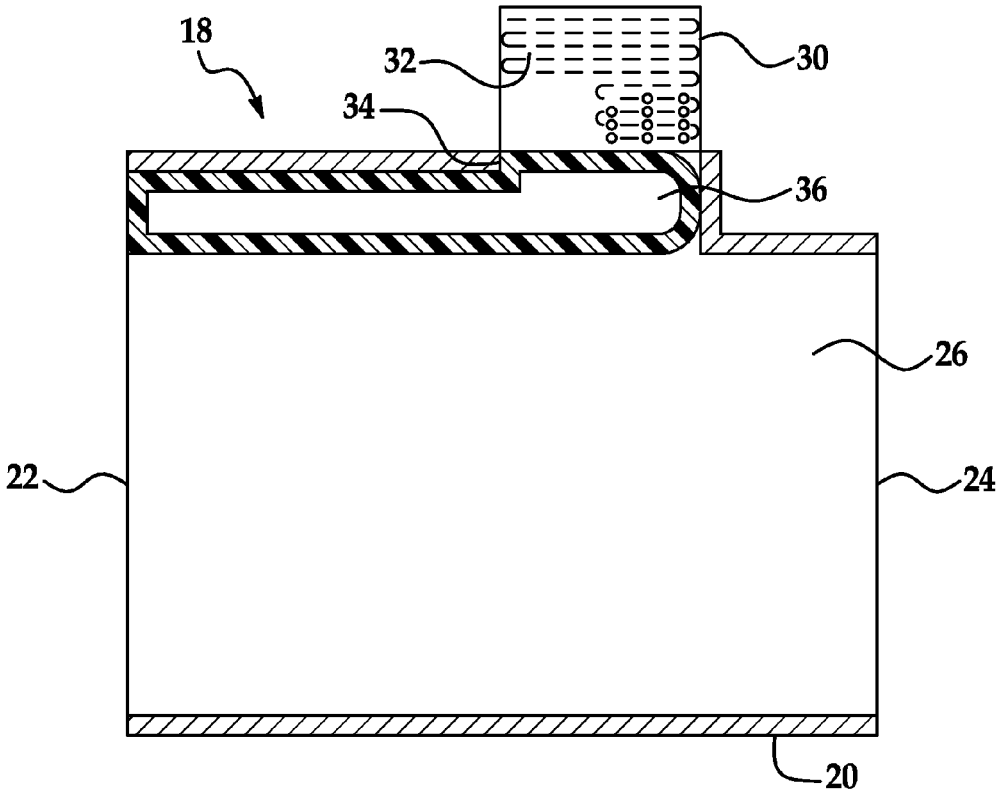
FIG. 7 is a simplified cross-sectional view of the fire suppression system depicting a longitudinally extending cross section through a duct with an aperture formed therein and a longitudinal groove extending radially outwardly from an internal surface of the duct, and a reservoir for holding a fire retardant material where a temperature sensitive sidewall separates the reservoir from the duct in the form of a frangible tube with a temperature-sensitive sidewall positioned within the groove and connected in fluid communication with a reservoir.

Referring now to FIG. 4, a cross-section view shows a fire suppression system 18 with a duct 20, reservoir 30 and a temperature-sensitive sidewall 34. The temperature-sensitive sidewall 34 can be a frangible tube 40 inserted through the aperture 36 on the sidewall 26 of the duct 20. The sidewall 26 of the duct 20 can include an outwardly projecting groove 42 having depth dimension of sufficient distance to allow support of the frangible tube 40 in a substantially flush position with respect to the interior surface of the sidewall 26 or the duct 20. The groove 42 can house the frangible tube 40 in a substantially flush position with respect to the sidewall 26 in order to prevent any obstruction to the air flow through the duct 20. The groove 42 can be formed longitudinally along the sidewall 26 of the duct 20 with the aperture 36 formed in the outwardly expanded groove 42 allowing passage of the frangible tube 40 through the aperture 36 to position the frangible tube 40 within the groove 42 without obstructing the duct 20 as best seen in FIG. 7.

Figure 5:
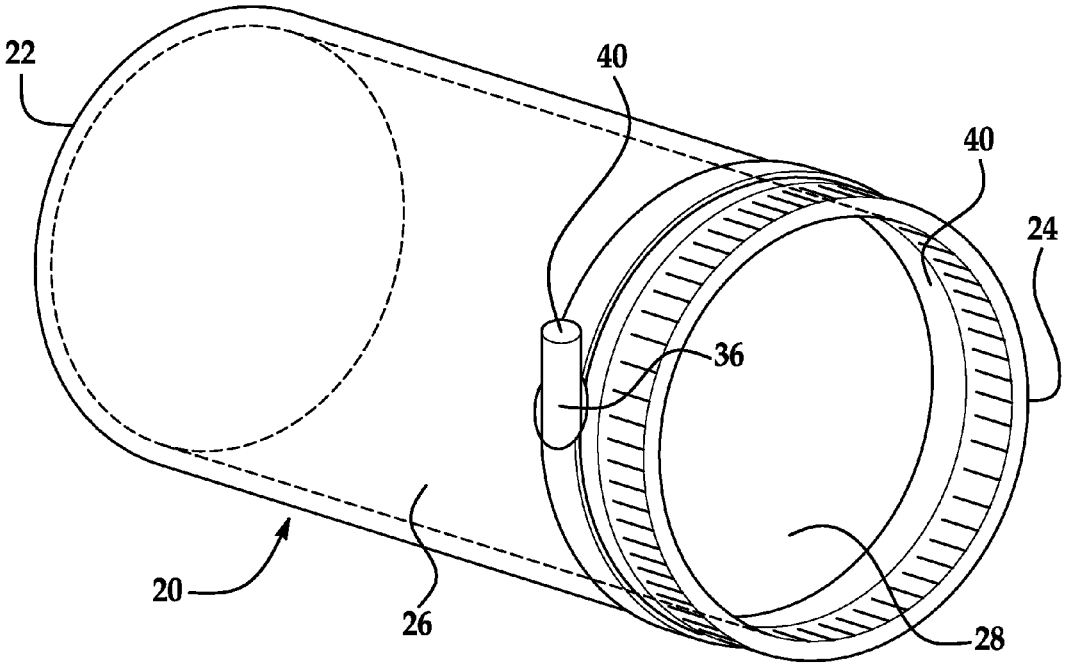
FIG. 5 is a simplified perspective view of the fire suppression system depicting a duct having an aperture communicating with a peripherally and radially outwardly extending groove formed therein for receiving a frangible tube with a temperature-sensitive sidewall positioned within the groove.
Figure 6:
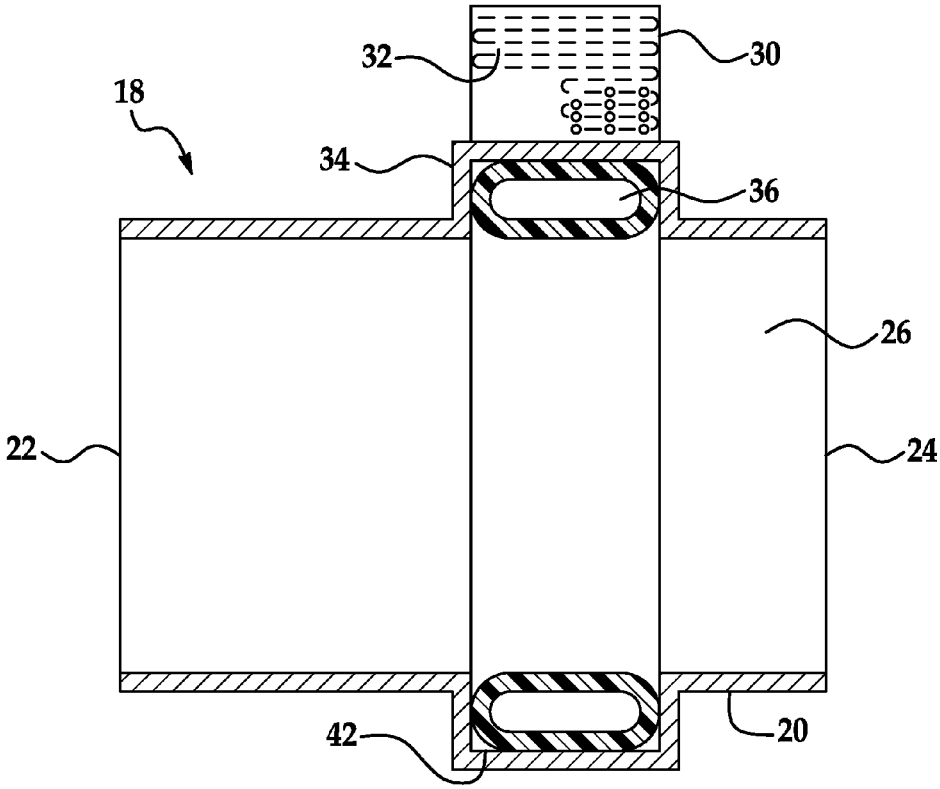
FIG. 6 is a simplified cross-sectional view of the fire suppression system depicting a longitudinally extending cross section through a duct with an aperture formed therein and a peripheral groove extending radially outwardly from an internal surface of the duct, and a reservoir for holding a fire retardant material where a temperature-sensitive sidewall separates the reservoir from the duct in the form of a frangible tube positioned within the groove and connected in fluid communication with a reservoir.

The groove 42 can be formed along a periphery of the interior surface of the sidewall 26 of the duct 20 and can be positioned adjacent to at least one of the first and second ends 22, 24 of the duct 20 as best seen in FIG. 5. The peripherally formed groove 42 can project outwardly from the interior surface of the sidewall 26 of the duct 20. The aperture 36 can be formed in the peripheral groove 42 allowing passage of the frangible tube 40 through the aperture 36 to position the frangible tube 40 within the groove 42 without obstructing the duct 20 as best seen in FIG. 6.

The frangible tube 40 can be secured within the groove 42 in a flush position after insertion through the aperture 36 formed in sidewall 26 of the duct 20. The frangible tube 40 can effectively seal the aperture 36 or additional packing material can be supplied to effectively seal the aperture 36 in order to prevent loss of air flow through aperture 36. The temperature-sensitive sidewall 34 can define at least part of the frangible tube 40. The frangible tube 40 can be connected in fluid communication with the reservoir 30 containing the fire retardant material 32. When the frangible tube 40 is ruptured in response to exposure to a temperature in excess of a predetermined value, fluid communication can be established between the interior volume 28 of the duct 20 and the reservoir 30.

The frangible tube 40 can melt when exposed to a predetermined temperature within the interior volume 28 of the duct 20. When the frangible tube 40 melts, the fire retardant material 32 housed within the reservoir 30 can be released into the interior volume 28 of the duct 20. The release of the fire retardant material 32 can extinguish or suppress the source of heat. The frangible tube 40 can be any material meant to disintegrate, rupture, or melt when a temperature within the interior volume 28 of the duct 20 reaches a predetermined level. The fire retardant material 32 housed within the reservoir 30 can be any material meant to suppress, or retard fires or sources of heat. By way of example and not limitation, the material can be a liquid, gas, or a mixture of liquid and gas, and any combination thereof. The fire suppression system 18 can be placed at varying intervals along the length of the duct 20 inside a building in order to suppress, retard, or inhibit the progress of fires through the duct system of a building.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. In a fire suppression system (18) for a duct (20) with a first end (22) and a second end (24) and at least one sidewall (26) extending between the first and second end, wherein the sidewall (26) defines an interior volume (28) of the duct (20), the improvement comprising:

a reservoir (30) for storing a volume of fire retardant material (32); and a temperature-sensitive sidewall (34) in fluid communication with the reservoir (30) and exposed to the interior volume (28) of the duct (20) through an aperture (36) formed in the at least one sidewall (26) allowing introduction of the fire retardant material (32) into the interior volume (28) of the duct (20), the temperature-sensitive sidewall (34) substantially flush with respect to the at least one sidewall (26) of the duct (20), wherein the temperature-sensitive sidewall (34) includes a frangible tube (40) insertable through the aperture (36) formed in the at least one sidewall (26) of the duct (20), and wherein the at least one sidewall (26) of the duct (20) includes a groove (42) formed therein with a depth dimension of sufficient distance to support the frangible tube (40) in a substantially flush position with respect to the at least one sidewall (26) of the duct (20).

2. The fire suppression system (18) of claim 1, wherein the groove (42) is formed longitudinally along the at least one sidewall (26) of the duct (20) and the aperture (36) formed in the groove (42).

3. The fire suppression system (18) of claim 1, wherein the groove (42) is formed peripherally on the duct (20) and the aperture (36) is formed in the groove (42).

4. The fire suppression system (18) of claim 1, wherein the frangible tube (40) is in fluid communication with the reservoir (30) containing the fire retardant material (32), the frangible tube (40) effectively closing the aperture (36) in the duct (20).

5. The fire suppression system (18) of claim 1 further comprising:

the frangible tube (40) operably responsive to an increase in temperature within the duct (20) such that at a predetermined temperature the frangible tube (40) melts allowing the fire retardant material (32) to be expelled into the interior volume (28) of the duct (20) to suppress a source of heat within the duct (20).

6. A method for assembling a fire suppression system (18) for a duct (20) with a first end (22) and a second end (24) and at least one sidewall (26) extending between the first and second end, wherein the at least one sidewall (26) defines an interior volume (28) of the duct (20) comprising:

supporting a reservoir (30) for storing a volume of a fire retardant material (32); and associating a temperature-sensitive sidewall (34) in fluid communication with the reservoir (30) and exposed to the interior volume (28) of the duct (20) through an aperture (36) formed in the at least one sidewall (26) allowing introduction of the fire retardant material (32) into the interior volume (28) of the duct (20), the temperature-sensitive sidewall (34) substantially flush with respect to the at least one sidewall (26) of the duct (20);

positioning a frangible tube (40) in a substantially flush position with respect to the at least one sidewall (26) with the temperature-sensitive sidewall (34) defining at least part of the frangible tube (40) and exposed to the interior volume (28) of the duct (20), such that when a predetermined temperature is reached within the interior volume (28) of the duct (20) the frangible tube (40) melts allowing the fire retardant material (32) to be expelled into the interior volume (28) of the duct (20);

forming a groove (42) along an interior surface of the at least one sidewall (26) of the duct (20) with a depth dimension of sufficient distance to support the frangible tube (40) in a substantially flush position with respect to the at least one sidewall (26) of the duct (20); and securing the frangible tube (40) within the groove (42) in a substantially flush position with respect to the at least one sidewall (26) of the duct (20).

7. The method of claim 6 further comprising:

forming the groove (42*a*) peripherally along an interior surface of the at least one sidewall (26) of the duct (20).

8. The method of claim 6 further comprising:

forming the groove (42*b*) longitudinally along an interior surface of the at least one sidewall (26) of the duct (20).

9. A fire suppression system (18) comprising:

a duct (20) with a first end (22) and a second end (24) and at least one sidewall (26) extending between the first and second end, the at least one sidewall (26) defining an interior volume (28) of the duct (20) and including a groove (42) with an aperture (36) formed through the at least one sidewall (26) in communication with the groove (42);

a reservoir (30) for storing a volume of fire retardant material (32); and a temperature-sensitive sidewall (34) in fluid communication with the reservoir (30) and exposed to the interior volume (28) of the duct (20) through the aperture (36) formed in the at least one sidewall (26) allowing introduction of the fire retardant material (32) into the interior volume (28) of the duct (20), the temperature-sensitive sidewall (34) substantially flush with respect to the at least one sidewall (26) of the duct (20)), wherein the temperature-sensitive sidewall (34) includes a frangible tube (40) insertable through the aperture (36) formed in the at least one sidewall (26) of the duct (20), and the groove (42) formed in the at least one sidewall (26) having a depth dimension of sufficient distance to support the frangible tube (40) in a substantially flush position with respect to the at least one sidewall (26) of the duct (20).

* * * * *